US005247445A

United States Patent [19]

Miyano et al.

[11] Patent Number: 5,247,445

[45] Date of Patent: Sep. 21, 1993

[54] CONTROL UNIT OF AN INTERNAL COMBUSTION ENGINE CONTROL UNIT UTILIZING A NEURAL NETWORK TO REDUCE DEVIATIONS BETWEEN EXHAUST GAS CONSTITUENTS AND PREDETERMINED VALUES

[75] Inventors: Hideyo Miyano, Niza; Yukihiko Suzaki, Nerima; Fumitaka Takahashi, Hoya; Ken-ichi Ogasawara, Fujimi, all of Japan

[73] Assignee: Honda Giken Kogyo Kabushiki Kaisha, Tokyo, Japan

[21] Appl. No.: 578,581

[22] Filed: Sep. 6, 1990

[30] Foreign Application Priority Data

Sep. 6, 1989 [JP] Japan ..... 1-231092

[51] Int. Cl.[5] ..... F02M 51/00

[52] U.S. Cl. ..... 364/431.12; 395/23; 364/431.05; 123/674; 123/488

[58] Field of Search ..... 364/431.05, 431.01, 364/431.03, 431.06, 431.11; 123/480, 440, 489, 472, 488, 672, 673, 674; 395/22, 23, 21

[56] References Cited

U.S. PATENT DOCUMENTS

| | | | |
|---|---|---|---|
| 4,483,300 | 11/1984 | Hosaka et al. | 123/440 X |
| 4,627,402 | 12/1986 | Saito et al. | 123/440 |
| 4,912,649 | 3/1990 | Wood | 395/23 |
| 4,914,603 | 4/1990 | Wood | 395/23 |
| 4,922,429 | 5/1990 | Nakajima et al. | 123/480 X |
| 4,962,741 | 10/1990 | Cook et al. | 123/489 |
| 4,991,102 | 2/1991 | Sakamoto et al. | 364/431.05 |
| 5,020,502 | 6/1991 | Wild | 364/431.05 |

*Primary Examiner*—Jack B. Harvey
*Assistant Examiner*—Edward Pipala
*Attorney, Agent, or Firm*—Lyon & Lyon

[57] ABSTRACT

A control unit for an internal combustion engine that compensates for variations in injection valve flow rate characteristics by detecting an operation status of the engine and then using this status information to calculate a supply air amount or supply fuel amount in accordance with the detected status. Exhaust gas constituents are detected and then used to correct the calculated supply air or supply fuel amount. The control unit compares the exhaust gas constituents with predetermined values and then uses a neural network to control the supply air amount or supply fuel amount to make any deviation between the exhaust gas constituents and the predetermined value approach zero.

30 Claims, 5 Drawing Sheets

CONTROL UNIT OF AN INTERNAL COMBUSTION ENGINE CONTROL UNIT UTILIZING A NEURAL NETWORK TO REDUCE DEVIATIONS BETWEEN EXHAUST GAS CONSTITUENTS AND PREDETERMINED VALUES

BACKGROUND OF THE INVENTION a. Field of the Invention

The present invention relates to a control unit for an internal combustion engine, and more particularly to a control unit for properly controlling the internal combustion engine by using a neural network.

b. Related Background Art

In the prior art, when fuel is to be supplied to an engine by a fuel injection system, one fuel injection valve is usually provided for each cylinder of the engine, an appropriate injection time for each fuel injection valve is set in accordance with the operation status of the engine, and the fuel injection valve is opened over the preset injection time to control the fuel supply amount.

Since the flow rate characteristic of each fuel injection valve inherently includes variance, the actual amount of fuel supplied may significantly differ from cylinder to cylinder even if the same fuel injection time is set for each of the fuel injection valves. As a result, fuel consumption and exhaust gas characteristic are deteriorated. In order to mitigate this problem, the prior art method groups fuel injection valves having similar flow rate characteristics for use in the cylinders of one engine.

However, according to this background art method, it is necessary to test all injection valves during their manufacture and to sort them into groups having similar flow rate characteristics. This process takes much time and manpower and results in a cost increase. Further, it is not possible under the prior art method to compensate for changes in the flow rate characteristics due to aging after shipment.

SUMMARY OF THE INVENTION

The present invention aims to solve the above problems. It is an object of the present invention to provide a control unit for an internal combustion engine that eliminates the sorting work ad the matching work of the fuel injection valves during the manufacturing process and that compensates for changes in flow rate characteristics due to aging after shipment. This object is achieved by optimally compensating for variations in the flow rate characteristics of the fuel injection valves.

Compensation for variations in valve flow rate characteristics is accomplished in accordance with the present invention by a control unit that detects an engine operation status, including at least the exhaust gas constituents of the engine, to calculate a supply air amount or supply fuel amount in accordance with the detected status and to control the internal combustion engine in accordance with the results of the calculation. The control unit compares the exhaust gas constituents with predetermined values. It then adjusts the supply air amount or supply fuel amount to make the comparison error zero.

In accordance with the present invention, the control unit optimally compensates for variation among the flow rate characteristics of the fuel injection valves and optimizes the matching between the flow rate characteristic of the suction air unit and the flow rate of the fuel injection valves. Accordingly, sorting and matching of the fuel injection valves during the manufacturing process are eliminated, and compensation for changes in flow rate characteristics due to aging after shipment is also accomplished.

The present invention will become more fully understood from the detailed description given hereinbelow and the accompanying drawings, both of which are given by way of illustration only and thus are not considered to limit the present invention.

Further scope of applicability of the present invention will become apparent from the detailed description given hereinafter. However, it should be understood that the detailed description and specific examples, while indicating preferred embodiments of the invention, are given by way of illustration only. Various changes and modifications within the spirit and scope of the invention will become apparent to those skilled in the art from this detailed description.

DESCRIPTION OF THE PREFERRED EMBODIMENT

Figure 1:
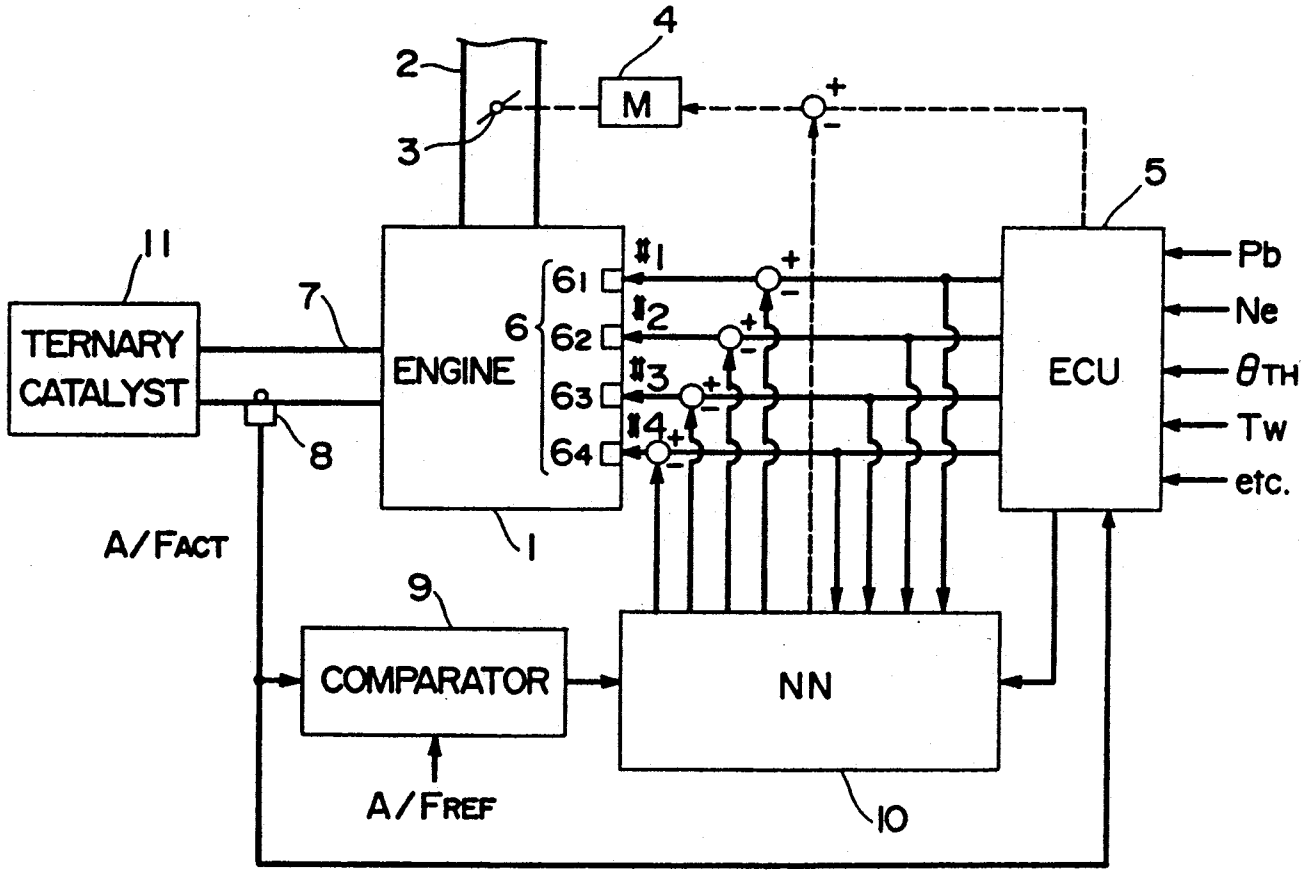
FIG. 1 shows an overall configuration of a fuel supply control unit in accordance with the present invention.

FIG. 1 shows an overall configuration of a fuel supply control unit in accordance with the present invention. As shown in FIG. 1, a throttle valve 3 is provided in a suction tube 2 of an internal combustion engine 1. A drive motor 4, which is a stepping motor for example, is coupled to the throttle valve 3. The drive motor 4 is electrically connected to an electronic control unit (ECU) 5. The throttle valve opening, which controls the suction air amount, is changed by pressing the accelerator pedal (not shown) and is also charged by driving the drive motor 4 based upon a signal from the ECU 5.

Fuel injection valves 6 are provided one for each of the cylinders (four in the present embodiment). Each fuel injection valve ($6_1$ to $6_4$ in the present embodiment) exists between the engine 1 and the throttle valve 3 and a little bit upstream of a suction valve (not shown) of the suction tube 2. Each fuel injection valve ($6_1$ to $6_4$) is connected to a fuel pump (not shown) and also electrically connected to the ECU 5. The valve open time (i.e., the fuel injection time) is controlled by a signal from the ECU 5 and a signal from an NN controller 10, which uses a neural network to be described later.

A ternary catalyst 11 is arranged in an exhaust tube 7 of the engine 1; and an air-to-fuel ratio sensor 8, which serves as an exhaust gas constituents sensor, is mounted upstream thereof. The air-to-fuel ratio sensor 8 is of the so-called proportional type, which produces a signal proportional to an oxygen concentration. It detects the oxygen concentration in the exhaust gas (i.e., an actual supply air-to-fuel ratio $A/F_{ACT}$) and supplies a detection signal to the ECU 5 and comparator 9.

The comparator 9 compares a reference value $A/F_{REF}$, which represents a target air-to-fuel ratio (for example, 14.7, but it may be varied with the operation status), with the value supplied by the air-to-fuel ratio sensor 8 $A/F_{ACT}$, which represents the actual supply air-to-fuel ratio, and supplies a signal representing the deviation between the two values to the controller (NN controller) 10, which uses a neural network.

As is well known, a neural network effects highly parallel, distributed data processing, and it is applicable to voice recognition, pattern recognition, and external environment comprehension. Typical neural networks includes Perceptron Type networks, Hopfield networks, and Boltzmann machines. A sequence generator which uses a Hopfield network is disclosed in U.S. Pat. No. 4,752,906.

Figure 2:
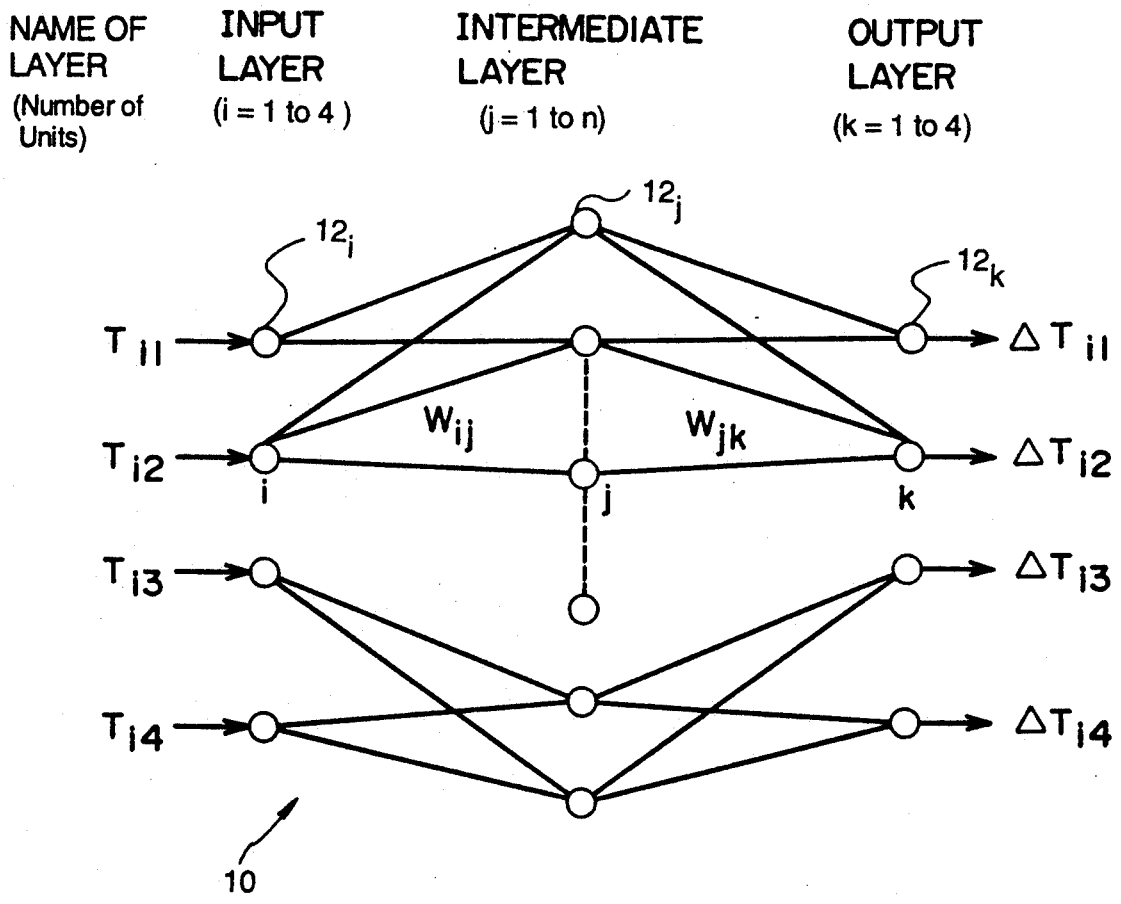
FIG. 2 shows a configuration of a three-layer type perceptron used in an NN controller 10 as a neural network.

As shown in FIG. 2, the NN controller 10 uses a three-layer type perceptron, which assures convergence to an optimum solution, and comprises an input layer, an intermediate layer, an intermediate layer, and an output layer, having four units $12_i$, n units $12_j$, and four units $12_k$, respectively. There is no coupling within a layer, and the units are coupled between the layers with a coupling weight (coupling load W). In FIG. 2, $W_{ij}$ and $W_{jk}$ indicate coupling loads between the i-th unit of the input layer and the j-th unit of the intermediate layer, and between the j-th unit of the intermediate layer and the k-th unit of the output layer, respectively. The units of the layers other than the input layer receive the weighted inputs from the units of the preceding layer, calculate the product sums (internal status), and multiply appropriate functions f thereto to produce outputs.

Supplied to the ECU 5 shown in FIG. 1 are suction tube internal pressure Pb, engine rotating speed Ne, throttle valve opening $\theta$ th, engine coolant temperature Tw from various sensors (not shown), and other engine parameter signals. The ECU 5 comprises an input circuit, which reshapes the input signal waveforms from the sensors, corrects the voltage levels to predetermined levels, and converts the analog signals to digital signals; a central processing circuit; memory means for storing various processing programs to be executed by the central processing circuit and the processing results; and an output circuit, which supplies a drive signal to the fuel injection valves 6.

ECU 5 determines the operation status in a feedback control operation area and an open control operation area based on the various engine parameter signals. It then uses that operation status and calculates the injection times $T_{ii}$ ($T_{i1}$ to $T_{i4}$) for the fuel injection valves 6 ($6_1$ to $6_4$) in accordance with the following formula (1).

$$T_{ii}=T_{iB}\times K_{02}\times K_{CR}\times K_{NN}+K_1 \quad (1)$$

In formula (1), $T_{iB}$ is a reference value (basic injection time) of the injection time $T_{ii}$ of the fuel injection valve $6_i$, which is read from a map (not shown) stored in the memory means of the ECU 5 in accordance with the suction air amount;

$K_{02}$ is an $O_2$ feedback correction coefficient determined in accordance with the oxygen concentration in the exhaust gas during the feedback control and set in accordance with the operation area during the open control operation area;

$K_{CR}$ is a correction coefficient that is set in accordance with the engine coolant temperature Tw and other engine parameter signals;

$K_{NN}$ is a correction coefficient that is set by learning of the neural network by a method to be described later, which, unlike other correction coefficients, is set for each of the fuel injection valves 6; and $K_1$ is an additive correction coefficient that is calculated in accordance with various engine parameter signals and assures optimum fuel consumption characteristics and acceleration characteristics to cope with an operation status of the engine.

The ECU 5 supplies a drive signal for opening the fuel injection valves 6 in accordance with the injection time $T_{ii}$ determined in the manner described above.

As shown in FIG. 2, the NN controller 10 supplies the injection times $T_{ii}$ ($T_{i1}$ to $T_{i4}$), which are set by the ECU 5, to the units $12_i$ of the input layer; calculates the output values $\Delta T_{ii}$, which are addition/subtraction signal values to the injection times $T_{ii}$, in accordance with the coupling weights W and the output function f; and supplies $\Delta T_{ii}$ to the corresponding fuel injection valve $6_i$. The NN controller 10 further corrects the coupling weight W in accordance with the output of the comparator 9 in a manner to be described later, and learns and corrects the correction coefficient $K_{NN}$ in accordance with the corrected coupling weight W.

Figure 3:
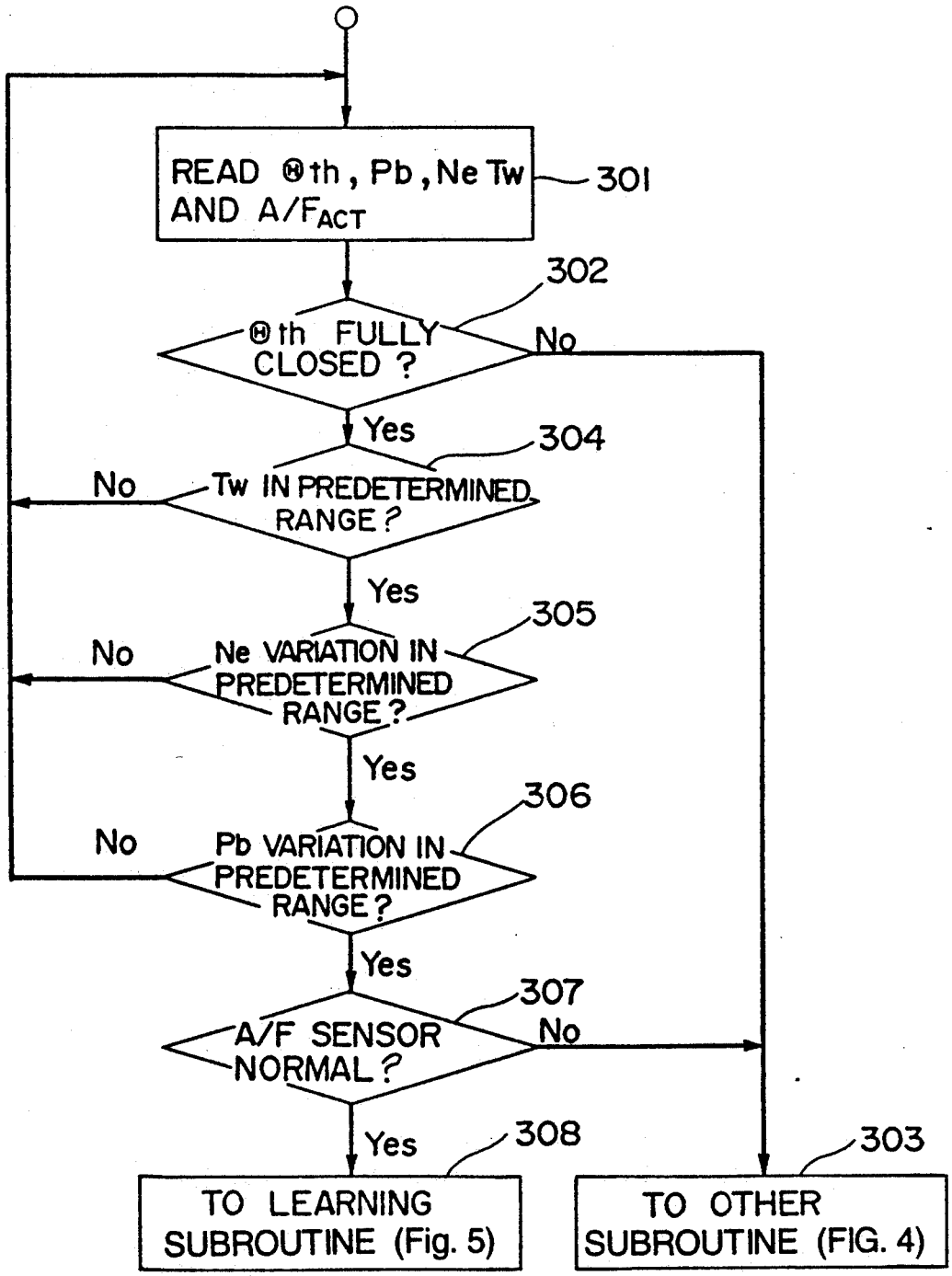
FIG. 3 shows a flow chart of a subroutine for determining an operation status of an engine.

FIG. 3 shows a subroutine executed by the ECU 5 to determine whether the predetermined engine operation status for which the correction coefficient $K_{NN}$ is to be learned and corrected is a stable idling operation status.

First, the throttle valve opening $\theta$ th, suction tube internal pressure Pb, engine rotating speed Ne, engine coolant temperature Tw, and the output $A/F_{ACT}$ of the air-to-fuel ratio sensor 8 are read in (step 301). Then, whether the throttle valve 3 is in an essentially closed state is determined by the throttle valve opening $\theta$th (step 302). If the decision is "No," then the engine is apparently not in the idling state and the process proceeds to a subroutine other than the correction coefficient $K_{NN}$ learning subroutine (step 303).

If the decision in step 302 is "Yes," that is, if the throttle valve is in an essentially closed state, then whether the engine coolant temperature Tw is in a predetermined range is determined (step 304). If the decision is "No," then the engine is in a warm-up state, and the process returns to step 301.

If the decision in step 304 is "Yes," that is, if the engine coolant temperature Tw is in the predetermined range, then whether variations of the engine rotating speed Ne and the suction tube internal pressure Pb (i.e., the difference between the previous readings and the present readings) are within a predetermined range is determined (steps 305 and 306). If either of these latter two decisions is "No", then the engine is not in the stable operation status, and the process returns to step 301. If the decision is "Yes", the process proceeds to step 307.

In step 307, whether the air-to-fuel ratio sensor 8 operates normally is determined by the detection value $A/F_{ACT}$. If the decision is "Yes," then the process proceeds to the correction value learning subroutine (step 308); but if the decision is "No," then the step 303 is executed, and the process proceeds to a subroutine other than the correction coefficient $K_{NN}$ learning subroutine (step 303).

In the decision subroutine of FIG. 3, the idling operation status is detected, and the correction coefficient $K_{NN}$ is learned during this operation status. Alternatively, another stable operation status, such as a cruise operation status or an overdrive operation status, may be used during the learning of the correction coefficient $K_{NN}$.

Figure 4:
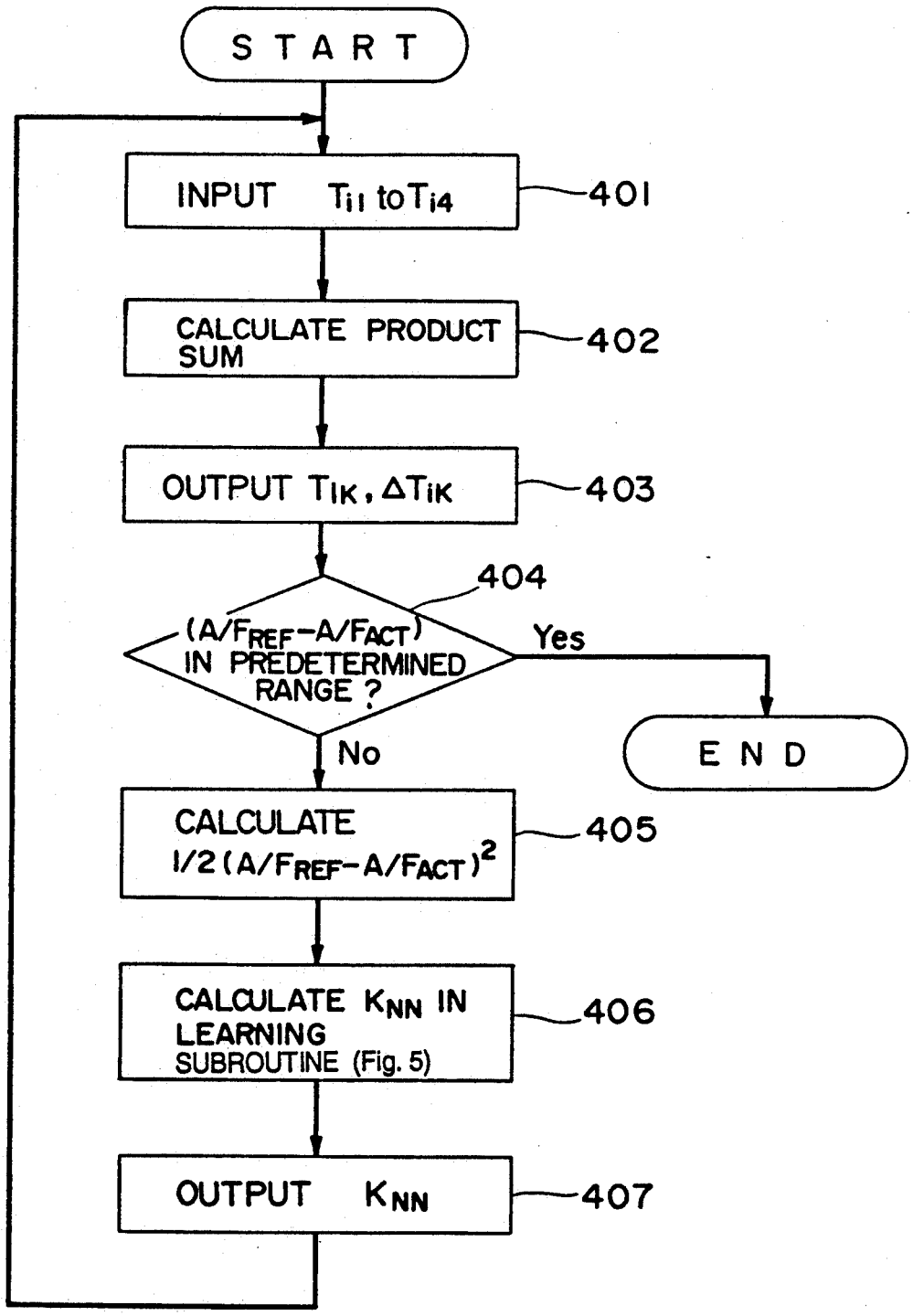
FIG. 4 shows a flow chart of a program for carrying out an operation in the NN controller 10 and determining whether a correction coefficient $K_{NN}$ is to be learned.

FIG. 4 shows a program that receives the injection times $T_{i1}$ to $T_{i4}$ of the fuel injection valves 6, which are set by the ECU 5 as input to the NN controller 10, and determines whether correction of the correction coefficient $K_{NN}$ is to be made. This program is basically provided for each cylinder, and it is executed at a timing that allows the air-to-fuel ratio sensor 8 to detect the exhaust gas constituents of each cylinder. This program is operable even if the air-to-fuel ratios for the respective cylinders are not detected at proper timing. The injection times $T_{i1}$ to $T_{i4}$ of the fuel injection valves 6, which are set by the ECU 5, are supplied to the first to fourth units of the input layer of the NN controller 10, as showing in FIG. 2 (step 401). Then, a product sum is calculated based on the input injection times $T_{i1}$ to $T_{i4}$ using the following formula (2) to determine the output value $\Delta T_{ik}$ of the k-th unit of the output layer (step 402).

$$\Delta T_{ik} = f\left(\sum_{j=1}^{n} W_{jk} f\left(\sum_{i=1}^{4} W_{ij} T_{ii}\right)\right) \quad (2)$$

In formula (2), $\Delta T_{ik}$ is an output value of the k-th unit of the output layer, which represents an addition/subtraction signal for the injection time $T_{ik}$ of the fuel injection valve $6_k$ for the k-th cylinder;

$W_{ij}$ and $W_{jk}$ are coupling weights between the i-th unit of the input layer and the j-th unit of the intermediate layer, and between the j-th unit of the intermediate layer and the k-th unit of the output layer, respectively; and f is an output function.

As the output value $\Delta T_{ik}$ of the k-th unit of the output layer, a random value may be added to the product sum value calculated by formula (2).

Then, the drive signal based on the injection time $T_{ik}$ is supplied from the ECU 5 to the fuel injection valve $6_K$ corresponding to the k-th cylinder; and the addition/subtraction signal $\Delta T_{ik}$ (calculated in step 402 based on $T_{ik}$) is also supplied (step 403). Thus, the actual injection time of the fuel injection valve $6_K$ is set as $T_{ik}+\Delta T_{ik}$.

Then, the signal of the comparator 9 is received at a timing that allows substantial detection by the air-to-fuel sensor 8 of the exhaust gas constituents of the k-th cylinder to which the fuel was supplied in step 403. It is next determined whether the signal from the comparator 9 (i.e., the difference $(A/F_{REF}-A/F_{ACT})$ between the target or reference air-to-fuel ratio and the supply air-to-fuel ratio) is within a predetermined range (step 404). If this decision is "Yes", then the supply air-to-fuel ratio $A/F_{ACT}$ is substantially equal to the target air-to-fuel ratio $A/F_{REF}$, and no correction is needed for the correction coefficient $K_{NN}$, and the program is terminated.

If the decision in step 404 is "No", then a square mean error between the target air-to-fuel ratio and the supply air-to-fuel ratio is calculated (step 405).

$$\tfrac{1}{2}(A/F_{REF}-A/F_{ACT})^2$$

The square average error is an error function in the learning subroutine (FIG. 5) to be described later. By using the square average error as the error function, the convergence to an optimum value is accelerated.

Then, the correction coefficient $K_{NN}$ is calculated in the learning subroutine (step 406), and the calculated correction coefficient $K_{NN}$ is supplied to the ECU 5 (step 407). Then, the process returns to step 401.

Figure 5:
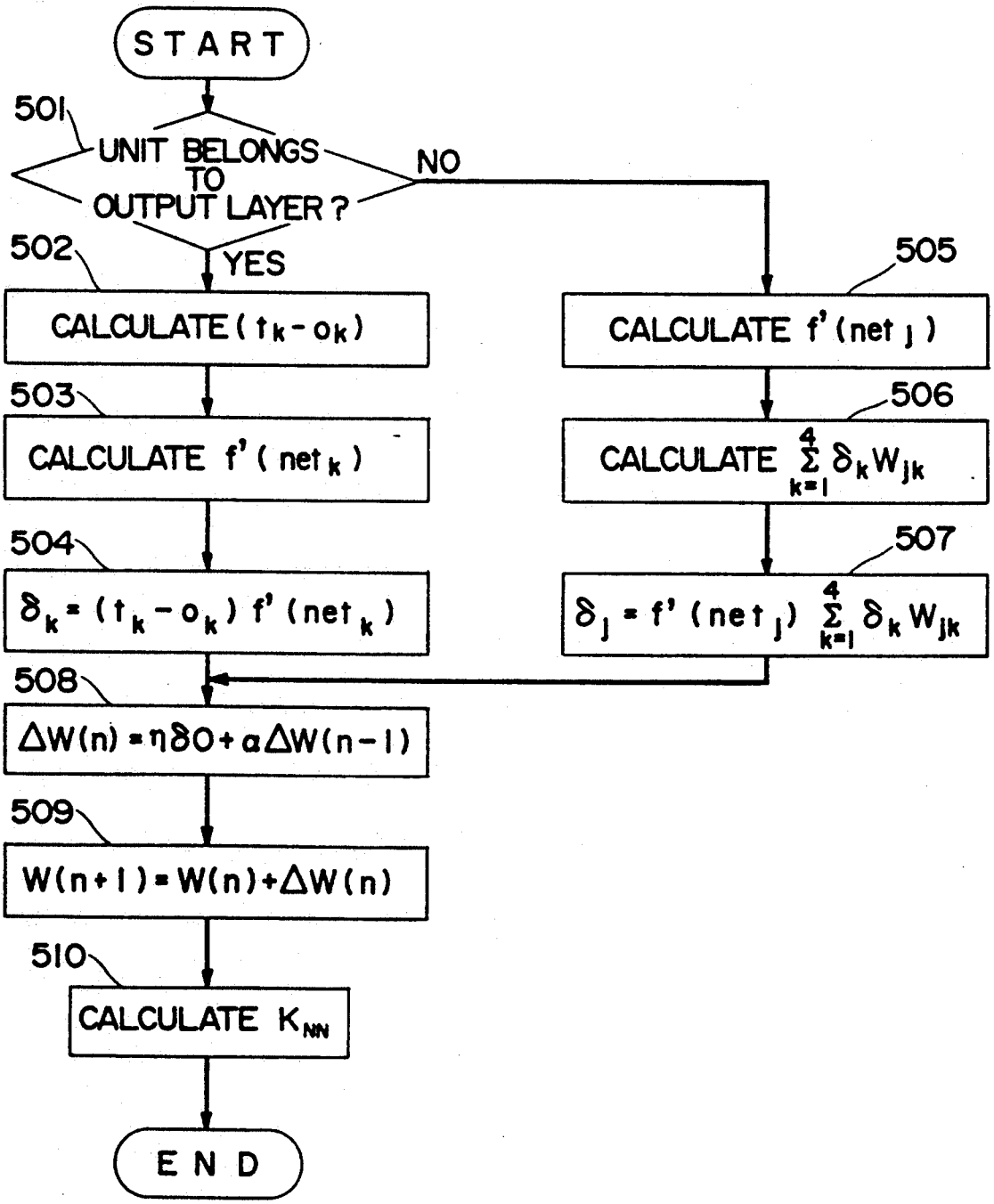
FIG. 5 shows a flow chart of a subroutine for learning the correction coefficient $K_{NN}$.

FIG. 5 shows the learning subroutine of the correction coefficient $K_{NN}$ which is executed by the NN controller 10. In the present subroutine, a so-called back propagation learning method is applied to the perceptron type network to learn and correct the coupling weight W between the units by using a learning signal $t_K$ (i.e, a target air to fuel ratio $A/F_{REF}$) to set the correction coefficient $K_{NN}$.

First, whether the unit under consideration belongs to the output layer is determined (step 501). If the decision is "Yes", then the difference between the learning signal $t_k$ of the unit of the output layer (i.e., the target air-to-fuel ratio $A/F_{REF}$) and the corresponding current output $O_K$ (i.e., the supply air-to-fuel ratio $A/F_{ACT}$) is determined (step 502).

Then, a primary differentiation f' ($net_k$) of the output function f for the current internal status value $net_k$ of the unit of the output layer is calculated (step 503). The internal status value $net_k$ is a sum of the inputs to the unit k and it is given by $$net_k = \sum_{j=1}^{n} W_{jk} O_j$$

where $O_j$ is an output of the j-th unit of the intermediate layer.

Then, the δ of the output layer is calculated based on the above value as follows (step 504).

$$\delta_k = (t_k - O_k) \times f'(net_k)$$

Then, the process proceeds to step 508.

If the decision in step 501 is "No" (i.e., if the unit under consideration belongs to the intermediate layer), the process proceeds to step 505 in which a primary differentiation f' ($net_j$) of the output function f for the current internal status value $net_j$ is calculated in the same manner used in step 503. The internal status value $net_j$ is given by $$net_j = \sum_{i=1}^{4} W_{ij} O_i = \sum_{i=1}^{4} W_{ij} T_{ii}$$

Then, the product of $\delta_k$ of the higher level layer to which the unit under consideration couples (i.e., the output layer) and the coupling weights $W_{jk}$ of those units is determined for all units of the higher level layer having the coupling relation, and the sum of the resulting products $\Sigma\delta_k W_{jk}$ is determined (step 506). Then, $\delta_j$ of the intermediate layer is calculated based on the above calculated value as follows (step 507).

$$\delta_j = f'(net_j) \sum_{k=1}^{4} \delta_k W_{jk}$$

Then, the process proceeds to step 508.

In step 508, a correction value $\Delta W_{ji}$ (n) of the coupling weight is calculated in accordance with formula (3) based on $\delta$ calculated in step 504 or 507.

$$\Delta W(n)=\eta\delta O+\alpha\Delta W(n-1) \quad (3)$$

where $\eta$ and $\alpha$ are learning coefficients that are determined by experience (usually, $\eta>\alpha$);

$\delta$ is the $\delta$-value of the coupled lower level layer;

O is an output level of the higher level layer; and $\Delta W(n-1)$ is a correction value of the coupling weight at one-cycle earlier time.

Then, the coupling weight W is corrected by the following formula (4) (step 509).

$$W(n+1)=W(n)+\Delta W(n) \quad (4)$$

Then, the correction coefficient $K_{NN}$ is calculated based on the coupling weight W as corrected in step 509 (step 510), and the program is terminated.

In this manner, the coupling weight W is learned such that the difference between the target air-to-fuel ratio $A/F_{REF}$ and the actual supply air-to-fuel ratio $A/F_{ACT}$ detected by the air-to-fuel ratio sensor 8 is eliminated. The learning is repeatedly executed so that the coupling weight W and the correction coefficient $K_{NN}$ (calculated based on the coupling weight W) converge to optimum values for each fuel injection valve $6_1$ to $6_4$. When these values converge to their optimum values, this compensates for variations of the flow rate characteristics among the fuel injection valves.

In the present embodiment, the injection time $T_i$ is set for each fuel injection valve, and the time is supplied to the corresponding unit of the input layer of the neural network. Alternatively, the injection time $T_i$ which is set in common for all of the fuel injection valves, may be supplied to the input layer, or not only the injection time $T_i$ but also other parameters which affect the operation of the engine, such as engine coolant temperature, atmosphere pressure, throttle valve opening, and engine rotating speed, may be supplied.

In the present embodiment, the supply fuel amount is corrected by the neural network. Alternatively, as shown by broken lines in FIG. 1, the rotation amount of the throttle valve 3 may be set by a signal from the neural network to the drive motor 4 in accordance with the operation condition of the engine to control the suction air amount. The injection time of a fuel injection valve may then be set in accordance with the suction air amount to correct for the rotation amount of the throttle valve 3 as set by the drive motor 4.

In the above embodiment, the controller that uses the neural network is mounted on the engine with the ECU. Alternatively, the controller may be used as a jig to determine the correction value at the time of shipment of the engine, and the determined correction value may be stored in the non-volatile memory of the ECU. In either case, the sorting work of the fuel injection valves may be omitted.

In accordance with the present invention, the supply fuel amount or the supply air amount is optimally corrected by the neural network so that the supply air-to-fuel ratio coincides with the target air-to-fuel ratio in accordance with the output of the exhaust gas sensor. Alternatively, the supply fuel amount may be optimally controlled by the neural network such that it is controlled in accordance with a desired value in idling rotating speed control, velocity control for the auto-cruise drive, or slip rate control in the traction control.

Further, various engine parameters, such as throttle valve opening, engine rotating speed, vehicle velocity, and running resistance, may be supplied as input information. Then, the running status of the car and the road condition may be determined collectively by the neural network, and an optimum accelerator throttle valve opening characteristic may be selected from a plurality of preset characteristics in accordance with the determined results to automatically control the engine.

From the invention thus described, it is obvious that the invention my be varied in many ways. Such variations are not to be regarded as a departure from the spirit and scope of the invention, and all such modifications as would be obvious to one skilled in the art are intended to be included within the scope of the following claims.

We claim:

1. A control unit for an internal combustion engine for detecting an operation status of said internal combustion engine, comprising detection means for detecting at least one engine parameter including at least exhaust gas constituents indicating the operation status of said internal combustion engine;

calculation means for calculating a supply fuel amount to said engine based on said operation status;

compare means for comparing said exhaust gas constituents with predetermined values; and control means for correcting said supply fuel amount by using a neural network to render the deviation between said exhaust gas constituents and said predetermined values to zero.

2. A control unit for an internal combustion engine according to claim 1 wherein said engine has a plurality of cylinders and the control of said supply fuel amount by said control means is done for each cylinder.

3. A control unit for an internal combustion engine according to claim 1 wherein said neural network produces at least one correction coefficient for determining said supply fuel amount.

4. A control unit for an internal combustion engine according to claim 3 wherein said control means corrects said supply fuel amount calculated by said calculation means in accordance with said correction coefficient.

5. A control unit for an internal combustion engine according to claim 1 wherein said control means uses said neural network to control when said operation status indicated by said engine parameter or parameters is detected by said detection means.

6. A control unit for an internal combustion engine for detecting an operation status of the internal combustion engine, comprising detection means for detecting at least one engine parameter including at least exhaust gas constituents indicating the operation status of said internal combustion engine;

compare means for comparing said exhaust gas constituents with predetermined values;

control means for producing a correction coefficient for the supply fuel amount by using a neural network such that a deviation between said exhaust gas constituents and said predetermined values is rendered to zero;

calculation means for calculating said supply fuel amount to said engine in accordance with said operation status and said correction coefficient; and flow adjustment means for adjusting said supply fuel amount to said engine in accordance with the value calculated by said calculation means.

7. A control unit for an internal combustion engine according to claim 6 wherein said neural network includes an input layer having as many units as the number of cylinders, an output layer having as many units as the number of cylinders, and an intermediate layer arranged between said input layer and said output layer; and wherein the units are coupled with predetermined coupling weights only across the layers to form a three-layer type perceptron neural network.

8. A control unit for an internal combustion engine according to claim 7 wherein said control means corrects said coupling weights among the units by applying a back propagation learning method to said three-layer type perceptron neural network, and corrects the correction coefficient for said calculation means.

9. A control unit for an internal combustion engine according to claim 7 wherein said control means corrects said coupling weights in accordance with the deviation between said exhaust gas constituents and said predetermined values, and supplies said correction coefficient to said calculation means in accordance with said corrected coupling weights.

10. A control unit for an internal combustion engine according to claim 9 wherein said control means corrects said coupling weights only when said at least one engine parameter is in a predetermined range and said engine is in a steady operation status.

11. A control unit for an internal combustion engine according to claim 6 wherein said control means produces an adjustment coefficient for said flow adjustment means in accordance with the operation result of said calculation means.

12. A control unit for an internal combustion engine according to claim 11 wherein said control means corrects said correction coefficient for said calculation means in accordance with the deviation between said exhaust gas constituents and said predetermined values after the control based on said adjustment coefficient has been done.

13. A control unit for an internal combustion engine according to claim 6 wherein said flow adjustment means is a fuel injection valve provided for each cylinder.

14. A control unit for an internal combustion engine according to claim 7 wherein said flow adjustment means includes a fuel injection valve provided for each cylinder, and wherein said control means supplies a value representative of said fuel amount to be sent to said fuel injection valve to the unit of the input layer corresponding to said cylinder.

15. A control unit for an internal combustion engine according to claim 7 wherein said control means supplies a predetermined common value to said units of said input layer.

16. A control unit for an internal combustion engine for detecting an operation status of said internal combustion engine, comprising detection means for detecting at least one engine parameter including at least exhaust gas constituents indicating the operation status of said internal combustion engine;

calculation means for calculating a supply air amount to said engine based on said operation status;

compare means for comparing said exhaust gas constituents with predetermined values; and control means for correcting said supply air amount by using a neural network to render the deviation between said exhaust gas constituents and said predetermined values to zero.

17. A control unit for an internal combustion engine according to claim 16 wherein said engine has a plurality of cylinders and the control of said supply air amount by said control means is done for each cylinder.

18. A control unit for an internal combustion engine according to claim 16 wherein said neural network produces at least one correction coefficient for determining said supply air amount.

19. A control unit for an internal combustion engine according to claim 18 wherein said control means corrects said supply air amount calculated by said calculation means in accordance with said correction coefficient.

20. A control unit for an internal combustion engine according to claim 16 wherein said control means uses said neural network to control when said operation status indicated by said engine parameter or parameters is detected by said detection means.

21. A control unit for an internal combustion engine for detecting an operation status of said internal combustion engine, comprising detection means for detecting at least one engine parameter including at least exhaust gas constituents indicating the operation status of said internal combustion engine;

compare means for comparing said exhaust gas constituents with predetermined values;

control means for producing a correction coefficient for the supply air amount by using a neural network such that a deviation between said exhaust gas constituents and said predetermined values is rendered to zero;

calculation means for calculating said supply air amount to said engine in accordance with said operation status and said correction coefficient; and flow adjustment means for adjusting said supply air amount to said engine in accordance with the value calculated by said calculation means.

22. A control unit for an internal combustion engine according to claim 21 wherein said neural network includes an input layer having as many units as the number of cylinders, an output layer having as many units as the number of cylinders, and an intermediate layer arranged between said input layer and said output layer; and wherein the units are coupled with predetermined coupling weights only across the layers to form a three-layer type perceptron neural network.

23. A control unit for an internal combustion engine according to claim 22 wherein said control means corrects said coupling weights among the units by applying a back propagation learning method to said three-layer type perceptron neural network, and corrects the correction coefficient for said calculation means.

24. A control unit for an internal combustion engine according to claim 22 wherein said control means corrects said coupling weights in accordance with the deviation between said exhaust gas constituents and said predetermined values, and supplies said correction coefficient to said calculation means in accordance with said corrected coupling weights.

25. A control unit for an internal combustion engine according to claim 24 wherein said control means corrects said coupling weights only when said at least one engine parameter is in a predetermined range and said engine is in a steady operation status.

26. A control unit for an internal combustion engine according to claim 21 wherein said control means produces an adjustment coefficient for said flow adjustment means in accordance with the operation result of said calculation means.

27. A control unit for an internal combustion engine according to claim 26 wherein said control means corrects said correction coefficient for said calculation means in accordance with the deviation between said exhaust gas constituents and said predetermined values after the control based on said adjustment coefficient has been done.

28. A control unit for an internal combustion engine according to claim 21 wherein said flow adjustment means is an air flow control valve provided for each cylinder.

29. A control unit for an internal combustion engine according to claim 22 wherein said flow adjustment means includes an air flow control valve provided for each cylinder, and wherein said control means supplies a value representative of said supply air amount to be sent to said air flow control valve to the unit of the input layer corresponding to said cylinder.

30. A control unit for an internal combustion engine according to claim 22 wherein said control means supplies a predetermined common value to said units of said input layer.

* * * * *